US006048615A

United States Patent [19]

Lin

[11] Patent Number: 6,048,615

[45] **Date of Patent: *Apr. 11, 2000**

[54] FILAMENT HAVING A TRILOBAL CROSS-SECTION AND A TRILOBAL VOID

[75] Inventor: Perry Han-Cheng Lin, Hixson, Tenn.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,384

[22] Filed: Jan. 30, 1998

[51] Int. Cl.[7] ..... D02G 2/00

[52] U.S. Cl. ..... 428/397; 428/398; 428/376

[58] Field of Search ..... 428/397, 398, 428/376

[56] References Cited

U.S. PATENT DOCUMENTS

| | | | |
|---|---|---|---|
| 2,939,201 | 6/1960 | Holland . | |
| 2,939,202 | 6/1960 | Holland | 28/82 |
| 3,323,168 | 6/1967 | van Drunen | 18/8 |
| 3,329,553 | 7/1967 | Sim et al. . | |
| 3,493,459 | 2/1970 | McIntosh et al. | 161/178 |
| 3,528,128 | 9/1970 | Murakami et al. . | |
| 3,745,061 | 7/1973 | Champaneria et al. | 161/178 |
| 4,020,229 | 4/1977 | Cox, Jr. | 428/372 |
| 4,279,053 | 7/1981 | Payne et al. | 15/159 A |
| 4,468,830 | 9/1984 | Peterson et al. | 425/464 |
| 4,492,731 | 1/1985 | Bankar et al. | 428/361 |
| 4,770,938 | 9/1988 | Peterson et al. | 428/398 |
| 5,125,818 | 6/1992 | Yeh et al. | 425/131.5 |
| 5,168,143 | 12/1997 | Kobsa | 219/121.72 |
| 5,190,821 | 3/1993 | Goodall et al. | 428/398 |
| 5,208,107 | 5/1993 | Yeh et al. | 428/397 |
| 5,230,957 | 7/1993 | Lin et al. | 428/398 |
| 5,259,753 | 11/1993 | Kobsa | 425/461 |
| 5,279,897 | 1/1994 | Goodall et al. | 428/398 |
| 5,322,736 | 6/1994 | Boyle et al. | 428/397 |
| 5,362,563 | 11/1994 | Lin | 428/398 |
| 5,370,935 | 12/1994 | Agarwal et al. | 428/398 |
| 5,380,592 | 1/1995 | Tung | 428/397 |
| 5,523,155 | 6/1996 | Lin et al. | 428/376 |
| 5,686,121 | 11/1997 | Samuelson | 425/461 |

FOREIGN PATENT DOCUMENTS

| | | | |
|---|---|---|---|
| 0016450 | 10/1980 | European Pat. Off. . | |
| 201812 | 11/1986 | European Pat. Off. | D01D 5/24 |
| 516119 | 12/1992 | European Pat. Off. | D01D 5/24 |
| 60 007045 | 3/1978 | Japan | D01D 5/24 |
| 60-231818 | 12/1986 | Japan | D01D 5/24 |
| 62-206008 | 9/1987 | Japan . | |
| 6 3175 109 | 7/1988 | Japan | D01D 5/24 |
| 7-238419 | 12/1995 | Japan . | |
| WO 94/13869 | 6/1994 | WIPO | D01D 5/24 |

OTHER PUBLICATIONS

Patent Abstract of Japan, vol. 097, Dec. 25, 1997. Japan 09 217225 A (Toray Ind. Inc.) Aug. 19, 1997 (see abstract).

*Primary Examiner*—Newton Edwards

[57] ABSTRACT

A synthetic polymer filament is characterized by a trilobal void that extends centrally and axially through the filament. Each apex of the void extends toward the approximate midpoint of one side of the exterior configuration of the filament. The trilobal void has a modification ratio in the range from about 1.4 to about 3.0 and occupies from about five percent (5%) to about thirty percent (30%) of the cross sectional area of the filament. At a given constant void percentage a decrease of modification ratio increases the degree of sparkle.

A spinneret plate for producing the thermoplastic synthetic polymer filament has a cluster of three generally arrow-shaped orifices centered about a central point. Each orifice is defined by a first and a second outer leg joined together at a pointed end directed away from a central point of the cluster. Each orifice has a central leg extending from the jointure of the outer legs toward the central point of the cluster. Each outer leg has a free end thereon which is spaced from the free end of an outer leg of an adjacent orifice to define a gap therebetween.

1 Claim, 2 Drawing Sheets

FILAMENT HAVING A TRILOBAL CROSS-SECTION AND A TRILOBAL VOID

BACKGROUND OF THE INVENTION

1. Field of the Invention

The Present Invention relates to a generally trilobal filament having a central axial trilobal void useful as carpet yarn having high "glitter", excellent durability, and good soiling resistance and, to a spinneret plate for producing the filament.

2. Description of the Prior Art

The term "glitter", when describing a filament used to form a carpet yarn, is a characteristic of the luster of the yarn and refers to the shiny appearance of a yarn when light is reflected by it. A yarn having a high glitter is also synonymously described in the art as having a "metallic" luster or a high degree of "sparkle".

Recently, carpet yarn having levels of glitter higher than those used in the past have become fashionable. Accordingly, it is believed desirable to provide a filament useful in forming a carpet yarn that exhibits a high degree of glitter.

SUMMARY OF THE INVENTION

The present invention is directed to a thermoplastic synthetic polymer filament which, due to its high glitter, excellent durability, and good soiling resistance, is believed to be especially useful as carpet yarn. The filament of the present invention has an exterior configuration having three sides and an exterior modification ratio from about 1.4 to about 2.3 and a trilobal void extending centrally and axially therethrough. Each apex of the void extends toward the approximate midpoint of one side of the exterior configuration of the filament. The trilobal void has a modification ratio in the range from about 1.4 to about 3.0 and occupies from about five percent (5%) to about thirty percent (30%) of the cross sectional area of the filament. At a given constant void percentage a decrease of modification ratio increases the degree of glitter.

In another aspect the present invention is directed to a spinneret plate for producing the thermoplastic synthetic polymer filament as above described. The spinneret plate has a cluster of three generally arrow-shaped orifices centered about a central point. Each arrow-shaped orifice is defined by a first and a second outer leg joined together at a pointed end. The pointed end of each arrow-shaped orifice is directed away from the central point of the cluster. Each arrow-shaped orifice has a central leg extending from the jointure of the outer legs toward the central point of the cluster. Each outer leg has a free end thereon. The free end of an outer leg of each arrow-shaped orifice is spaced from the free end of an outer leg of an adjacent orifice to define a gap therebetween. The gaps are positioned such that an extension of the central leg of each arrow-shaped orifice passes through a gap defined between the legs of the other arrow-shaped orifices.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1:
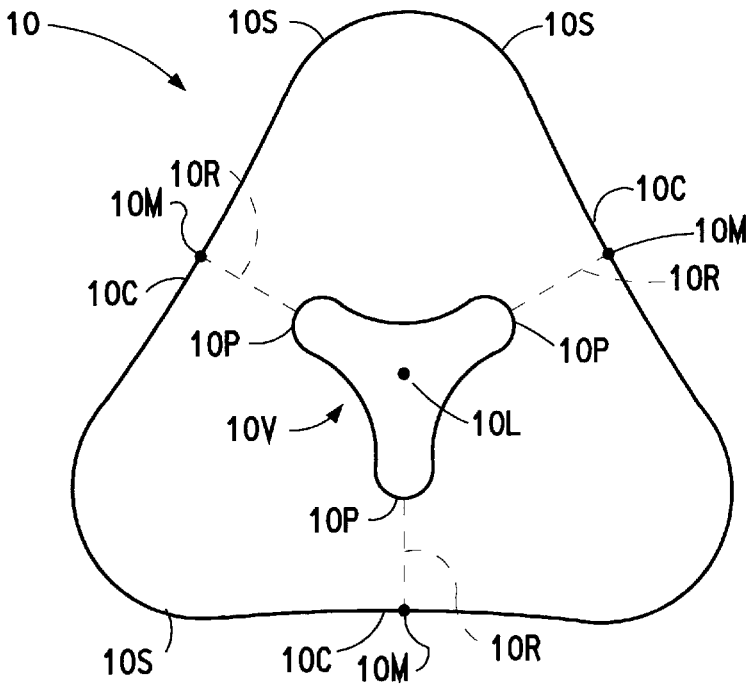
FIG. 1 is a cross section view of a filament in accordance with the present invention as produced in Example 1 hereof.

Throughout the following detailed description similar reference numerals refer to similar elements in all Figures of the drawings.

Figure 3:
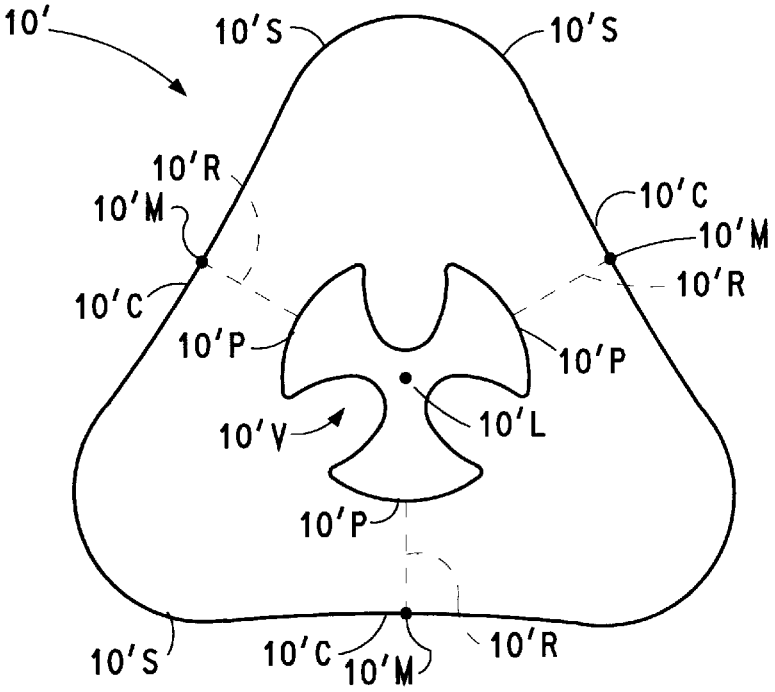
FIG. 3 is a cross section view of a filament in accordance with the present invention as produced in Example 2 hereof.

FIGS. 1 and 3 are cross section views of a thermoplastic synthetic polymer filament generally indicated by the characters 10, 10', each in accordance with the present invention. Generally speaking, the filament 10, 10' in accordance with the present invention has a three-sided exterior configuration and has an exterior modification ratio in the range from about 1.4 to about 2.3. It is specifically noted that such an exterior configuration encompasses so-called triangular (delta)-shaped as well as trilobal configurations. It should also be noted that an increased modification ratio of the exterior of the filament may result in increased soilability.

More particularly, the filament 10, 10' as respectively illustrated in FIGS. 1 and 3 may be characterized as having an exterior configuration that is substantially equilaterally triangular in axial cross-section, with each side 10S, 10' S of the filament 10, 10', respectively having a slight concavity 10C, 10' C formed therein. Each concavity 10C, 10' C lies approximately midway along a side 10S, 10' S of the exterior configuration of the filament 10, 10'.

The filament 10, 10' has a trilobal void 10V, 10' V extending centrally and axially therethrough. The trilobal void 10V, 10' V has a modification ratio (MR) in the range from about 1.4 to about 3.0. The void 10V occupies from about five percent (5%) of the cross sectional area of the filament 10 to about thirty percent (30%) of the cross sectional area of the filament 10. The void 10V in FIG. 1 occupies about six percent (6%) of the cross sectional area of the filament 10, while the void 10' V as illustrated in FIG. 3) occupies about eighteen percent (18%) of the cross sectional area of the filament 10'.

In accordance with the present invention the central void 10V, 10' V is positioned with respect to the central axis 10L, 10' L of the filaments 10, 10' such that each apex 10P 10' P of the void 10V, 10' V extends toward the concavity 10C, 10'° C of the proximal side of the exterior configuration of the filament. As indicated in FIGS. 1 and 3 each apex 10P, 10' P of the void 10V, 10' V is generally radially aligned (along the reference line 10R, 10' R) with the midpoint 10M, 10' M of each side of the exterior configuration of the filament 10, 10'.

A filament in accordance with the present invention may be prepared using a synthetic, linear, thermoplastic melt-spinnable polymers, including among these polyamides, polyesters, and polyolefins. After melting the polymer is extruded ("spun") through a spinneret plate 20 (to be described hereinafter) under conditions which vary depending upon the individual polymer and the particular filament being spun thereby to produce a filament having a desired denier and a desired void percentage. Void percentage can be increased by a more rapid quenching and increasing the melt viscosity, which can slow the flow allowing sturdy, pronounced molding to occur.

Figure 2:
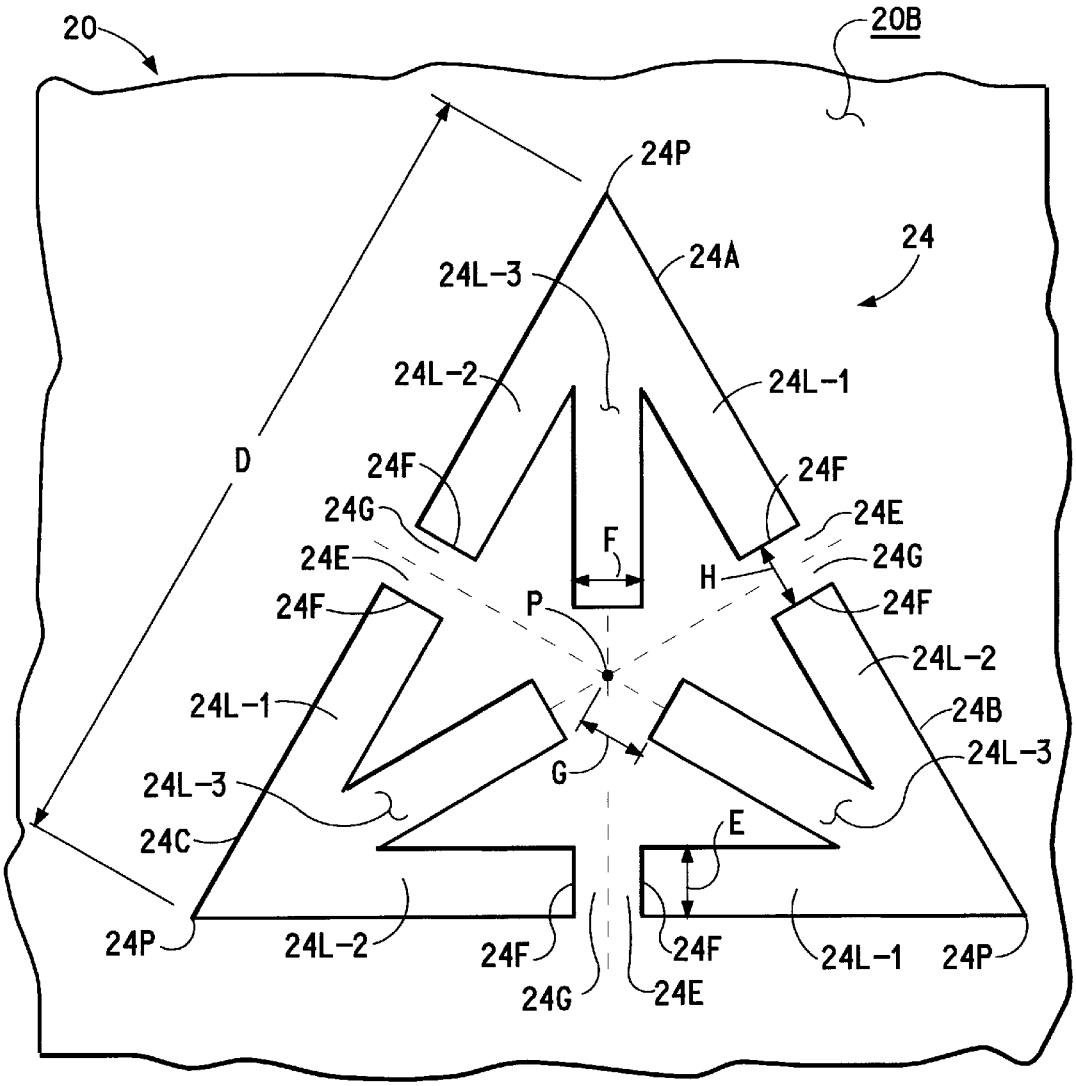
FIG. 2 is a view of the bottom surface of a spinneret plate having a cluster of apertures forming therein for producing the filament shown in FIGS. 1 and 3.

The present invention is also directed to a spinneret plate 20 for producing the filament depicted in FIGS. 1 and 3. A view of the bottom surface 20B of the spinneret plate 20 is shown in FIG. 2.

As is known in the art a spinneret plate 20 is a relatively massive member having an upper surface and a bottom surface 20B. A portion of the upper surface of the spinneret plate is provided with a bore recess whereby connection of the plate 20 to a source of polymer may be effected. Depending upon the rheology of the polymer being used the lower margins of the recess may be inclined to facilitate flow of polymer from the supply to the spinneret plate. If provided, a typical angle of inclination is on the order of about one hundred fifty degrees (1500).

A capillary generally indicated by the reference character 24 extends through the plate 20 from the recessed upper surface to the bottom surface 20B. As is seen in FIG. 2 the capillary 24 is defined by a cluster of three generally arrow-shaped orifices 24A, 24B, and 24C. The orifices 24A, 24B, and 24C are centered about a central point P. Each arrow-shaped orifice is defined by a first and a second outer leg 24L-1, 24L-2 that are joined together to form a pointed end 24P. Each pointed end 24P of each arrow-shaped orifice is directed away from the central point P of the cluster. Each arrow-shaped orifice has a central leg 24L-3 extending from the jointure of the outer legs 24L-1, 24L-2 toward the central point P of the cluster.

Each outer leg 24L-1, 24L-2 has a free end 24F. The free end 24F of each outer leg of each arrow-shaped orifice is spaced from the free end of an outer leg of an adjacent orifice to define a gap 24G therebetween. The gaps 24G are positioned such that an extension 24E of the central leg 24L-3 of each arrow-shaped orifice 24A, 24B, or 24C passes through a gap 24G defined between the legs of the other two arrow-shaped orifices.

The various above-defined features of the capillary 24 that open onto the bottom surface 20B of the spinneret plate 20 are defined by parallel surfaces that extend from the bottom surface 24B for at least a portion of the way through the thickness of the plate. This distance is usually termed in the art as the "cap depth". The parallel surfaces are spaced from each other by a dimension known in the art as the "slot width". In the production of a polyamide filament the surfaces defining the apertures of the capillary extend in parallel relationship completely through the thickness of the plate 20. For filaments made of other materials, such as polypropylene, it sometimes preferred (for considerations relating to the spinning process) that the parallel surfaces extend over only a predetermined portion of the thickness distance from the lower to the surface of the recess in the spinneret plate. Over the remaining portion of this thickness of the plate the surfaces defining the apertures incline outwardly from the axis of the aperture at an angle of inclination on the order of about fifty degrees (50°). The overall dimension of the slot (perpendicular to the bottom surface 20B) is usually referred to in the art as the "slot depth". The slot depth is understood to include both the parallel portion of the slot and the tapered portion of the slot.

The spinneret plate may be fabricated using the laser technique disclosed in U.S. Pat. No. 5,168,143, (Kobsa et al., QP-4171-A) assigned to the assignee of the present invention.

EXAMPLE 1

Using a spinneret plate having a capillary 24 with a cap depth of 0.0150 inches (with no tapered portion), a bore recess diameter in the upper surface of 0.1360 inches, and having the following dimensions for the various portions of each of the spinneret apertures as indicated by the corresponding reference characters on FIG. 2:

D (dimension)=0.0791",

E (slot width, legs 24L-1, 24L-2)=0.0110",

F (slot width, central leg 24L-3)=0.0085",

G (dimension)=0.0070", and

H (dimension)=0.0075", nylon 6,6 polymer of temperature 286° C. was spun at a throughput of 326 gram/min. Ninety (90) filaments were then drawn through a quenching chimney having a quench airflow between 250 to 350 CFM. This drawing was done by a feed roll of speed 768 ypm which, in turn, was drawn again by the draw rolls rotating at 2063 ypm; (a draw ratio of 2.7). The draw roll temperature was 225° C. Next, a bulking jet at 240° C., 120 psi crimped the heated filaments before they moved onto the perforated surface of a bulking drum rotating at 65 rpm inside a bulking chest. Finally, the filaments were taken by a pair of take-up rolls and wound onto the winders rotating at 1891 ypm.

A filament 10 having a cross-section as shown in FIG. 1 and an exterior modification ratio of about 1.8 was thereby produced, the filament having a 6.3% void percentage and a void modification ratio of 2.2. The filaments were tufted to form a loop pile carpet construction. The carpet was dyed to medium blue.

The carpet produced using the filament formed in the manner described was compared for glitter with two carpet samples formed from two trilobal cross section yarn having three and six voids, (Comparative samples A and B, respectively) and to a carpet formed from a square filament having four voids (Comparative sample C). The results are as tabulated in the following Table.

The glitter value in the Table was measured by ten viewers on a scale of "1" to "5", with a value of "5" being the most glitter. The rating for each sample was averaged to produce the value in the Table.

TABLE

| | Ex. 1 | Comp. Ex. A | Comp. Ex. B | Comp. Ex. C |
|---|---|---|---|---|
| Glitter | 5 | 1.7 | 1.0 | 1.6 |

It is also believed that for a given void percentage a filament exhibits increasing sparkle for decreasing modification ratio of the void.

Note: Comparative Examples A and B are as described in U.S. Pat. No. 5,523,155 (Lin et al., RD-6965). Comparative Example C is as described in U.S. Pat. No. 5,190,821 (Goodall et al., RD-5865).

EXAMPLE 2

Using the same spinneret plate as was used to produce Example 1, polypropylene polymer of temperature 255° C. was spun at a throughput of 303 grams/minute. The filaments were then drawn through a quenching chimney hav ing a quench airflow of 350 CFM. This drawing was done by a feed roll of speed 655 ypm which, in turn, was drawn again by the draw rolls rotating at 1611 ypm; a draw ratio of 2.5. The draw roll temperature was 135° C. Next, a bulking jet at 160° C., 110 psi crimped the heated filaments before they moved onto the perforated surface of the bulking drum rotating at 50 rpm inside a bulking chest. Finally, the filaments were taken by a pair of take-up rolls and wound onto the winders.

A filament 10' having a cross-section as shown in FIG. 3 and an exterior modification ratio of about 1.5 was thereby produced, the filament having a 17.6% void percentage and a void modification ratio of 3.0.

Those skilled in the art, having the teachings of the present invention as hereinbefore set forth may effect numerous modifications thereto. It should be appreciated that such modifications are to be construed within the contemplation of the present invention, as defined by the appended claims.

What is claimed is:

1. A thermoplastic synthetic polymer filament having an exterior configuration having three sides thereon and an exterior modification ratio in the range from about 1.4 to about 2.3, the filament having a trilobal void extending centrally and axially therethrough, each apex of the void extending toward the approximate midpoint of one side of the exterior of the filament, the trilobal void having a modification ratio in the range from about 1.4 to about 3.0, the void occupying from about five percent (5%) to about thirty percent (30%) of the cross sectional area of the filament.

* * * * *